United States Patent [19]

Gourdine

[11] Patent Number: 4,555,909

[45] Date of Patent: Dec. 3, 1985

[54] METHOD AND APPARATUS FOR IMPROVED COOLING OF HOT MATERIALS

[75] Inventor: Meredith C. Gourdine, East Orange, N.J.

[73] Assignee: Energy Innovations, Inc., East Orange, N.J.

[21] Appl. No.: 529,754

[22] Filed: Sep. 6, 1983

[51] Int. Cl.[4] ..... F25D 17/02

[52] U.S. Cl. ..... 62/64; 134/36; 264/28; 239/434; 239/568; 239/597

[58] Field of Search ..... 62/64; 134/34, 36; 264/28; 239/434, 568, 597

[56] References Cited

U.S. PATENT DOCUMENTS

| | | | |
|---|---|---|---|
| 3,519,855 | 7/1970 | Gourdine | 239/15 |
| 3,630,441 | 12/1971 | Felici et al. | 317/3 |
| 3,659,428 | 5/1972 | Kunioka et al. | 62/64 |
| 3,673,463 | 6/1972 | Gourdine | 55/107 |
| 3,693,352 | 9/1972 | Hinze et al. | 62/64 |
| 3,757,491 | 9/1973 | Gourdine | 239/3 |
| 3,791,579 | 2/1974 | Cowan | 239/3 |
| 3,991,710 | 11/1976 | Gourdine et al. | 317/3 |
| 4,065,252 | 12/1977 | Hemsath et al. | 62/64 |
| 4,249,893 | 2/1981 | Mayers et al. | 62/64 |

OTHER PUBLICATIONS

"Quenching of Steel", ASM Committee Publication, H. J. Bates, Chairman, Metals Handbook, vol. 2, ASM (1976).

*Primary Examiner*—Ronald C. Capossela
*Attorney, Agent, or Firm*—Brumbaugh, Graves, Donohue & Raymond

[57] ABSTRACT

A method and apparatus rapidly cools hot material of any shape without inducing distortion-causing temperature gradients between thick and thin sections. Water spray guns mounted on an enclosure surrounding the hot material launch drops of water towards the surface with sufficient speed to penetrate the vapor leaving the surface, but with insufficient flow rate to form a blanket of water thereon, to establish a turbulent mixture of water drops and vapor in equilibrium at the water boiling point temperature of 212° F. Turbulent heat transfer to the vapor and evaporation of drops maintain the surfaces of the enclosure and the hot material at 212° F. to cool the inner core of the hot material to 212° F. by conducting heat to its surface. Irregularly shaped objects are cooled by setting each gun water spray rate to be proportional to the thickness of material where its jet strikes or by directing air at thinner locations to minimize temperature gradients within the material. Electrogasdynamic (EGD) spray guns may be used to charge the drops and create a space-charge induced electrical field to propel drops toward the surface.

38 Claims, 7 Drawing Figures

METHOD AND APPARATUS FOR IMPROVED COOLING OF HOT MATERIALS

BACKGROUND OF THE INVENTION

This invention relates to a method and apparatus for cooling materials by a fluid spray process, and is particularly applicable for cooling hot materials formed by an extrusion process.

In the manufacture of products made of metal, glass, ceramics, or plastics e.g., it is often necessary to cool the product at a controlled rate in order to obtain desired properties of strength, ductility, or surface appearance. Several methods for cooling steel for example, are described in "Quenching of Steel" ASM Committee Publication, H. J. Bates, Chairman, Metals Handbook, Vol. 2, ASM (1976). The described cooling methods include use of a water bath, high speed water jets, air, and charged and uncharged water mists. However, all of these suffer from one or more limitations or disadvantages.

In the water bath method, the surface heat transfer rate is limited by the vapor that is trapped between the material surface and the liquid. Also, material shapes of non-uniform thickness are often distorted due to uneven cooling rates. Further, the water in the bath must be frequently cleaned.

In the high speed water jet method, closely spaced jets are used to penetrate the trapped vapor between the blanket of water and the hot surface. However, distortion due to uneven cooling is a problem especially for material having thin or non-uniform shapes. Moreover, large quantities of water must be cleaned, chemically treated, and recirculated.

The air cooling method is frequently used to cool thin or non-uniform shapes slowly in order to avoid distortion of the material. However, this method requires a large floor space.

When cooling an object with an uncharged mist, droplets of water are suspended in air. While this method is faster than air cooling alone and reduces floor space, it is inefficient because most of the water drops drift away without being evaporated. When using a charged water mist to cool hot materials, a larger percentage of the water drops reach the object due to electrostatic attraction. However, some water drops still drift away without evaporating.

In summary, the above-described methods result in distortion of the material because of non-uniform cooling, have a slow cooling rate, require the use of large quantities of cooling fluid, are inefficient, and/or require the use of a large space or working area.

SUMMARY OF THE INVENTION

An objective of the present invention is to allow hot objects of thin cross-section or irregular shape to be cooled rapidly without distortion.

Another objective of the present invention is to minimize the flow of fluid required to cool the object, thereby reducing the cost of cleaning, chemically treating, and circulating the fluid.

Another objective of this invention is to reduce the floor space, and size and complexity of the equipment used for cooling.

The present invention provides a method and apparatus for cooling an object of hot material. According to the method, at least one and preferably a plurality of fluid jets are directed at the hot material surface with sufficient speed to penetrate the fluid vapor leaving the surface, but with a drop size and fluid flow rate small enough to prevent the formation of a liquid blanket on the surface, which would severely limit the rate of heat transfer out of the hot material. Preferably, the fluid is water and is sprayed from jet guns mounted on an enclosure which substantially encloses the material. The hot material is preferably moved relative to the spray jets, so that the surface will not be allowed to cool down to below the water boiling point of 212° F., because otherwise a water blanket will form which would significantly reduce evaporation and heat transfer.

According to a specific form of the invention, a plurality of high speed air jets are provided in addition to water jets, to induce small-scale turbulence in the vapor, thereby increasing the heat transfer rate from the hot surface to the vapor. Some of the high speed air jets may be used to atomize water and launch drops at high speed towards the hot surface.

Preferably, the jets of water and air provide a highly turbulent mixture of water drops and vapor at equilibrium with each other at one atmosphere pressure and at the water boiling temperature of 212° F. Accordingly, heat transfer from the hot surface is primarily due to the evaporation of water drops that are able to cross the boundary layer on the hot surface.

According to another specific form of the invention, the jet guns which produce the fluid jets are of the electrogasdynamic (EGD) type and shoot electrically charged water drops. Such EGD guns are described in my copending U.S. patent application Ser. No. 310,534, filed Oct. 13, 1981 now U.S. Pat. No. 4,433,003 issued Feb. 21, 1984, and in U.S. Pat. Nos. 3,519,855, 3,673,463, 3,757,491, and 3,991,710. With the hot object electrically grounded, the charged water drops are electrostatically attracted across the laminar boundary layer to the hot surface where they evaporate to thereby increase the evaporative heat transfer rate.

Further, by maintaining the turbulent mist, enclosure and guns all at the 212° F. water boiling point, the temperature of the hot body or material will be reduced to 212° F. as water drops are evaporated on its surface. The highly turbulent water mist at a uniform temperature of 212° F. will uniformly cool the surface of a thin or irregularly shaped body, because if a particular surface area should tend to rise to a temperature higher (or lower) than its neighboring surface areas, that surface area would cool faster (or slower) until it reaches the temperature of its surroundings. Therefore, rapid cooling of the hot material is obtained without material distortions which might otherwise occur when different parts of the material experience different temperatures.

Further, by providing an enclosure according to the invention, heat energy radiated from the hot surface will be absorbed by water drops between the object and enclosure, and on the enclosure walls, resulting in further cooling of the hot body by evaporation.

Also, the flux of water drop flow of each jet to a particular surface element is preferably proportional to the thickness of material below that surface element, thereby assuring more even cooling and less distortion.

Other objects and advantages will become apparent from the detailed description, appended claims and accompanying drawings.

DETAILED DESCRIPTION OF THE PREFERRED EMBODIMENTS

Figure 1A:
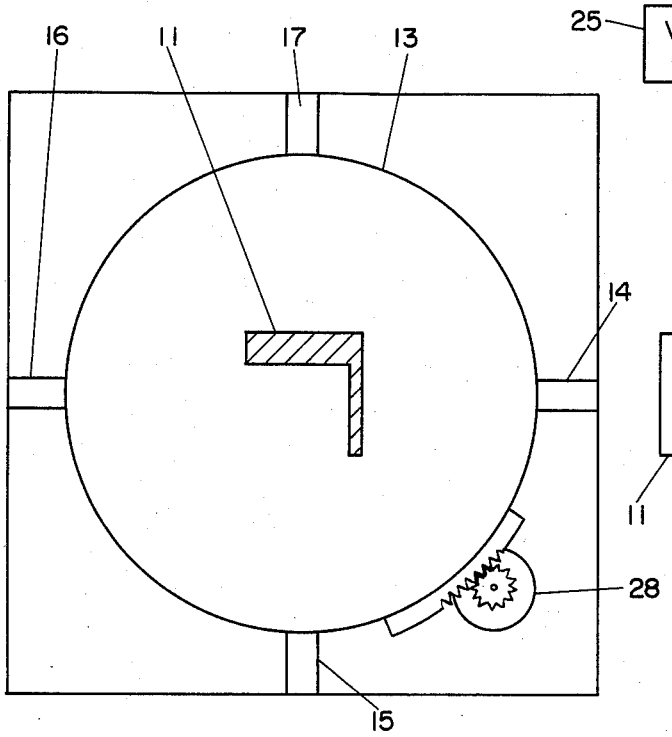
FIGS. 1A and 1B are an end view and a side view, respectively, of a turbulent mist cooling apparatus according to the invention, wherein an irregularly shaped hot object is cooled by spray guns mounted on an enclosure.
Figure 1B:
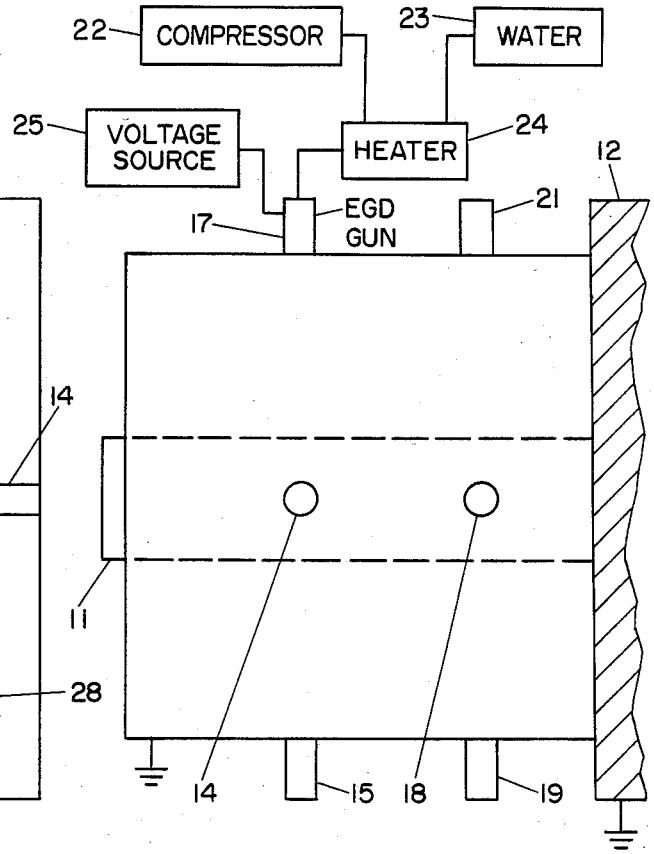

Referring to FIGS. 1A and 1B, a hot object or body 11 having an irregularly shaped L cross-section is extruded from an electrically grounded extrusion head or die 12, and moves from right to left in FIG. 1B through an electrically grounded enclosure 13 which supports eight spray guns 14 to 21. The four spray guns 15, 17, 19 and 21 are preferably, but not necessarily electrogasdynamic (EGD) spray guns. These guns are pointed at the thicker part of the body 11 and spray both charged water droplets and high speed air. The other four spray guns 14, 16, 18 and 20 (behind 16, in FIG. 1A) are pointed at the thinner part of the body 11 and spray only high speed air in order to induce more turbulence in the vapor at the surface of the body away from the location where the jets impinge. The surface temperature of the body 11 quickly becomes uniform because the turbulent mist temperature is uniform at 212° F., thereby transferring heat from the warmer portions faster than from the cooler portions. Therefore, temperature difference between the relatively thicker and thinner portions of the body is reduced or eliminated.

FIG. 1B shows one arrangement for an EGD spray gun according to the invention. The spray gun arrangement for the spray gun 17 comprises a compressor 22 and water source 23 connected to a water heater 24 which heats the water up to its 212° F. boiling point and provides the compressed hot water to EGD gun 17. Also, a voltage source 25 is provided to operate the EGD gun 17. Further details of various types of EGD guns and principles thereof are provided in my copending U.S. patent application Ser. No. 310,534, filed Oct. 13, 1981 now U.S. Pat. No. 4,433,003 issued Feb. 21, 1985, and in U.S. Pat. Nos. 3,519,855, 3,673,463, 3,757,491 and 3,991,710, which are incorporated herein by reference. Other spray guns in the various figures have a similar arrangement as that shown for spray gun 17. Of course, for the air guns, the water source would not be needed, and the gun itself would not be an EGD type gun.

It has been found that the minimum flow rate of water $\dot{m}$ that must be evaporated in order to cool material with mass flow rate $\dot{M}$ from its initial temperature $T_i$ to its final temperature $T_f$ is $$\dot{m}=\dot{M}C(T_i-T_f)/L_v, \quad (1)$$

where C is the heat capacity of the material and $L_v$ is the latent heat of vaporization of water.

It has been found that the surface of the hot body 11 is almost instantaneously cooled to the water boiling point $T_b=212°$ F. As long as water drops impinge on a particular surface portion without forming a blanket of water, the temperature of that surface portion will remain near $T_b=212°$ F. Furthermore, turbulent heat transfer by the vapor (also at $T_b=212°$ F.) will tend to keep the entire surface at a uniform temperature of $T_b=212°$ F., provided there is sufficient water to maintain a mist. Once the temperature of the surface is established and maintained at $T_b=212°$ F., heat from the inner portion of the material will diffuse to the surface and the body will cool.

Theoretically, the mass flow rate of water striking the surface equals the mass flow rate of vapor from the surface, i.e.

$$nmwA=A_v\rho_v c_v/4 \quad (2)$$

where A is the surface area, n is the concentration of water drops at the surface, m is the mass of each drop, w is the speed of the drops, $\rho_v$ is the equilibrium vapor density at the boiling point, $c_v$ is the mean thermal speed of the vapor molecules, and $A_v$ is the area on the surface wetted by the drops from which vapor emerges.

In order to achieve a high heat transfer rate a blanket of liquid should not be allowed to form on the surface. This is achieved when the wetted area fraction $A_v/A$ is less than or equal to one, or when $$nmw \leqq \rho_v c_v/4 \quad (3)$$

For water at its boiling point, $\rho_v=5.98$ kg/m$^3$ and $c_v=365$ m/s. Therefore, the mass flux of liquid n m w should be less than or equal to $\rho_v c_v/4$ or 546 kg/sec-m$^2$.

Typically, the water drop radius is $10^{-5}$m, corresponding to a mass $m=4\ \pi(10^{-5})^3/3=4\times10^{-12}$ kg/drop. Accordingly, to meet condition (3) the flux of water drops reaching the surface should satisfy the condition:

$$nw \leqq \frac{\rho_v c_v/4}{m} = 1.36 \times 10^{14} \frac{\text{drops}}{\text{sec} - \text{m}^2} \quad (4)$$

Further, the speed w of the water drops approaching the surface must be greater than or equal to the speed of water vapor coming off the surface, i.e., $$w \geqq 5c_v/4)(A_v/A) \quad (5)$$

Both the size (radius) and the speed w of the water drops can be controlled using fluid atomizing guns well known in the art by adjusting the size of the orifice and the pressure supplied to the gun. For example, a typical atomizing gun can be controlled to obtain drop sizes anywhere from 1 to 100 microns.

A theoretical maximum cooling rate will be achieved when the wetted area fraction equals one, or when n m w=546 kg/sec−m$^2$. The cooling rate is given by $$\dot{Q}/A=L_v\rho_v c_v/4. \quad (6)$$

For $L_v=2.25\times10^6$ Joules/Kg, the maximum cooling rate will then be $\dot{Q}/A=(2.25\times10^6)\ (546)=1.23\times10^9$ watts/m$^3$. Cooling rates of $10^7$ watts/m$^3$ have been obtained, which corresponds to a wetted area fraction of $A_v/A$ of about $10^{-2}$.

Since the fluid flow from the jet diverges (expands in cross-section) as it leaves the jet, the concentration of water drops n (number of drops per unit area) can be adjusted by moving the jet gun toward or away from the material surface. For example, in one experiment, a jet gun to material surface distance of $\frac{1}{8}''$ resulted in formation of a liquid water blanket for a certain liquid flow rate and drop size, but when the gun was moved away from the material surface a distance of $\frac{1}{2}''$, no water blanket formed.

It has been further found that when all of the spray guns shoot water at the same rate, the thin material sections cool at a rate faster than thicker material sections, resulting in distortion of the material. Therefore, in order to reduce or eliminate material distortion, water drops are sprayed only on the thicker section of the material in FIG. 1, and only high speed air is sprayed on the thinner section of the material. For material having a more complex cross-section, more guns with different rates of water flow can be used to minimize material distortion.

A study of the heat conduction equation in the material and the boundary condition at its surface show that the rate of decrease ($d\bar{T}/dt$) of the mean temperature ($\bar{T}$) of the material is proportional to the temperature gradient $(dT/dy)_o$ in the material at its surface, which in turn is proportional to the rate ($m\ n\ w\ L_v$) at which heat is used to evaporate water drops, where m is the mass of a water drop, n is its concentration, and w is its drift speed to the surface. To be precise, it has been found that $$d\bar{T}/dt=(-K/SDC)(dT/dy)_o=mnwL_v/SDC \quad (7)$$

where K is the heat conductivity of the material, S is the thickness of material at the surface portion under consideration, and D is the density of the material.

After integrating equation (7), the ratio of final to initial temperature as a function of time is given by $$T_f/T_i=1-t/\tau \quad (8)$$

where the time constant $\tau$ is given by $$\tau=SDCT_i/mnwL_v \quad (9)$$

This equation shows that by making the flux (m n w) of water drops which flow to a particular part of the surface proportional to the thickness of materials under that surface, the value of cooling time constant $\tau$ can be kept substantially equal over the entire body. This was found to be true in tests of the embodiment shown in FIG. 1.

Equation (9) also shows that the cooling time constant $\tau$ can be decreased by increasing the flux of water drops to all surfaces ($\tau$ can be kept constant if flux (m n w) is made proportional to S). This can be done by: (1) increasing the mass concentration (m n) of water drops in the mist, and/or (2) by increasing the drift speed w of the drops to the surface. The latter can be accomplished either by using more guns to launch the drops towards the surface at high speed, or by increasing turbulent and electrostatic diffusion to the surface. While turbulence will increase the concentration of water drops in the quiet boundary layer at the surface, electrostatic attraction is required to pull them across the boundary layer to the surface. Hence, electrogasdynamic (EGD) spray guns are used to provide charged water droplets, and drive them into the space-charge cloud against the space-charge induced electric field E. If the mean distance between the enclosure and the surface of the body is H, then the space-charge induced electric field E at each surface is found to be approximately $$E=qnH/2\epsilon_o \quad (10)$$

where q is the charge on a water drop, and $\epsilon_o$ is the permittivity of free space.

The space-charge induced electric field should not exceed the breakdown strength of air, and it is preferred that the space-charge concentration qn is as large as possible to maximize the flux of charged water drops to the surface. Accordingly, for these space-charge and water drop charge considerations (as well as for space considerations), it is preferred to keep H, the mean distance between the enclosure and the surface of the body, as small as possible.

If a body of finite length but irregular shape is to be cooled without distortion, then it should be preferably rotated and/or undulated in order to prevent a water blanket from forming under each jet. Alternatively, it may be desirable to vary the direction of the jets in some empirically determined manner, such as by moving the enclosure on which the guns are mounted by oscillating motor, gear and teeth arrangement 28, for example.

Figure 2A:
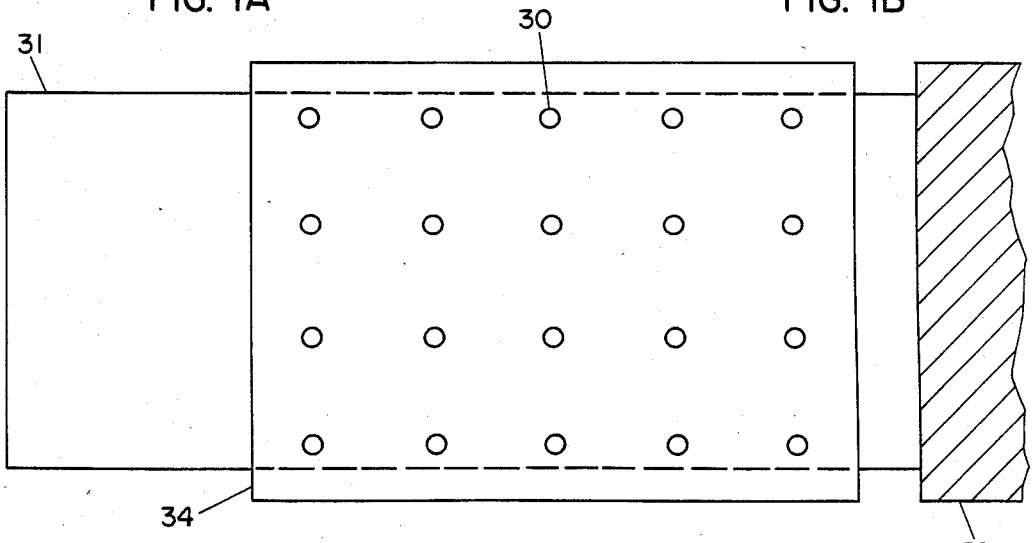
FIGS. 2A and 2B are a top plan view and a side view, respectively, of an apparatus for cooling one side of a plate of hot material according to the invention.
Figure 2B:
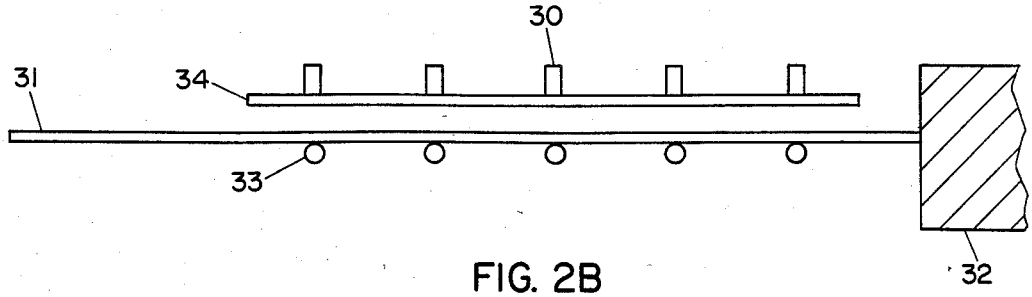

FIGS. 2A and 2B show an arrangement useful for cooling a flat plate or continuous sheets of material. In these figures, EGD spray guns 30 are disposed in a regular array over a sheet 31 moving from right to left over rollers 33 from an extrusion head 32. The EGD spray guns 30 are mounted on a grounded metal support plate 34 that confines the water mist close to the sheet 31. The number of spray guns, as well as the spacing and water flow rate from each gun should be optimally determined by such factors as the speed and thickness of the sheet, and the type of sheet material.

Figure 3:
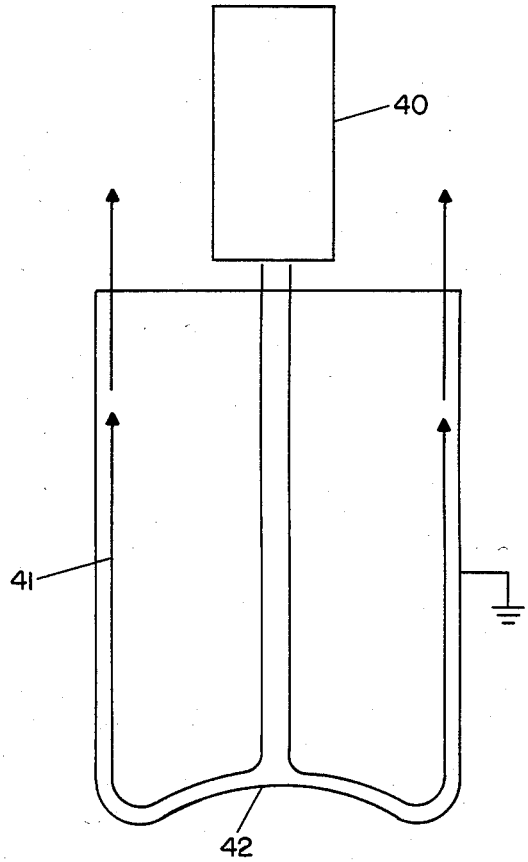
FIG. 3 is a cross-sectional side view of a can being cooled according to the invention.

The arrangement shown in FIG. 3 can be used for cooling the interior of an object 41, such as a grounded aluminum can 41 having an exteriorly concave bottom 42. In this arrangement an EGD spray gun 40 shoots charged water droplets towards the bottom 42 of the can 41. Some of the charged drops evaporate upon reaching the bottom, while other drops are swept upwards along the wall of the can by the vapor and air from the gun. Some of these latter drops precipitate on the grounded can wall due to turbulent and electrostatic diffusion. It has been found that charged drops increase the cooling rate fourfold over the cooling rate obtained using uncharged drops.

Figure 4A:
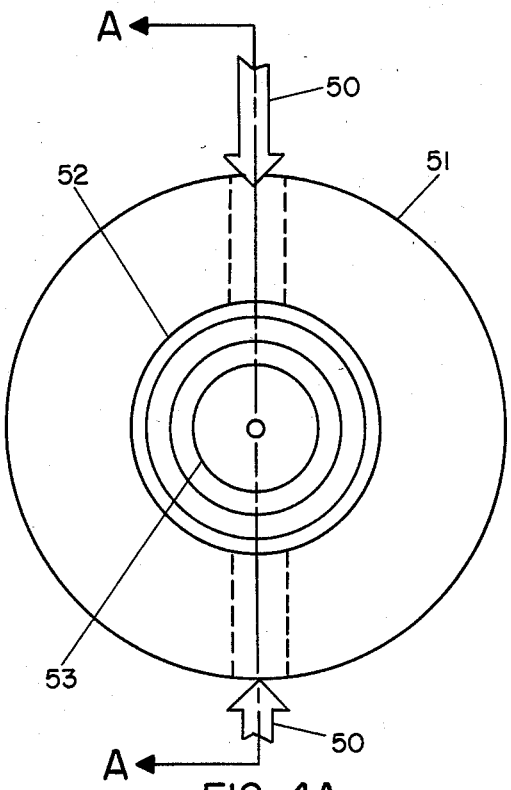
FIG. 4A is a front view of an apparatus for cooling the inside of a hot tube according to the invention.
Figure 4B:
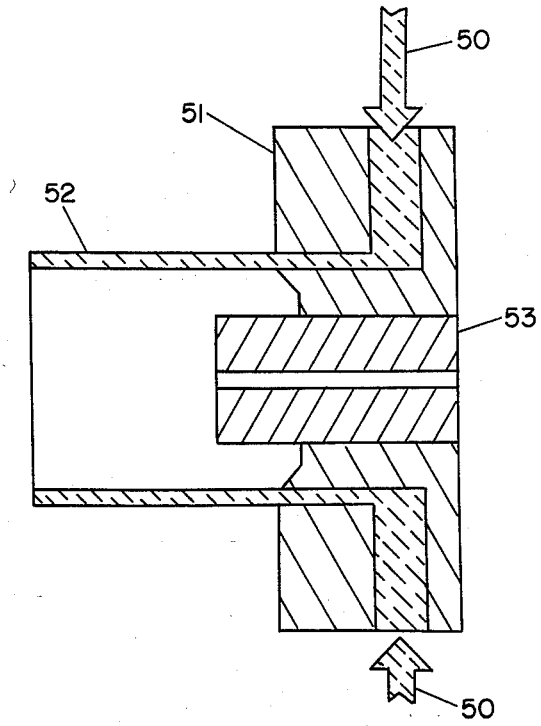
FIG. 4B is a cross-sectional side view taken along line A—A of FIG. 4A.

An arrangement for cooling an extruded tube is illustrated in FIG. 4, which shows hot material 50 entering the head or die of an extruder 51, and leaving the die in the shape of a tube 52. In this arrangement, a water spray gun 53 is mounted in the die of the extruder 51, so that the gun spray opening is preferably along the central axis of the tube 52. Water drops sprayed from this gun 53 evaporate on the inside wall of the hot tube and thus cool the tube. The vapor and water droplets eventually emerge from the tube at its left end.

The spray gun in this as well as the other arrangements can be of the EGD type, injecting charged water drops, whether or not the material is electrically conductive, because the charged drops repel each other, move towards the tube wall, and precipitate on the material faster.

Other than in the case of the tubular or other enclosed item, if the hot object in any of these illustrated or other arrangements is made of dielectric material and thus cannot be electrically charged, then there is really no reason to impart a charge to the drops. In such a case, the rate of cooling will be determined simply by the rate of turbulent diffusion obtained by using a plurality of spray guns to launch the water drops to the desired surface. However, high rates of cooling with uniform temperature distribution can still be obtained with proper location, orientation, and selection of water flow rate from each gun.

When the hot material to be cooled is electrically conductive and grounded, and when an EGD jet gun is mounted on an enclosure either electrically isolated from ground or made of dielectric material, the charged drops will build up on the enclosure and will drive the other drops towards the electrically grounded hot material.

Accordingly, one advantage of the method and apparatus of the invention is that even irregularly shaped objects can be cooled uniformly and rapidly without distortion. Another advantage of the method and apparatus of the invention is that it uses a minimum of cooling fluid, thereby minimizing operating and maintenance expenses. A further advantage of the invention apparatus is that it is simple to install and maintain, and consumes only a minimum of plant space. A further advantage of the method and apparatus according to the invention is that it is versatile enough to cool a wide variety of shapes and materials. Also, other cooling fluids can be used such as volatile oil and nitrogen instead of water and air respectively, when the hot surface must be protected from corrosion or oxidation, for example.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. A method for cooling hot material with cooling fluid, comprising:

directing at least one jet of atomized fluid towards the surface of the hot materials at a speed $\mu_1$ greater than the speed of fluid vapor $C_v/4$ leaving the surface of the hot material, and providing a fluid mass flow rate per unit area $m_1/A$ from said jet to said material less than the rate at which vapor leaves the surface per unit area, $\rho_v C_v/4$, where $\rho_v$ is the density of the vapor and $C_v$ is the mean thermal speed of the vapor molecules to thereby prevent the formation of a fluid film on the material surface.

2. The method according to claim 1, wherein the fluid is water, wherein $\rho_v=5.98$ kg/m$^3$, $C_v=365$ m/s, and $m_1/A$ is less than $\rho_v C_v/4=2.18\times10^3$ kg/m$^2$-sec.

3. The method according to claim 2, wherein the hot material to be cooled is electrically conductive and is electrically grounded, and wherein the step of directing at least one jet of atomized fluid comprises providing at least one electrogasdynamic water jet gun mounted on an enclosure so that charged water droplets are sprayed by the jet gun into the enclosure.

4. The method according to claim 2, wherein the hot material to be cooled is electrically conductive and is electrically grounded, and wherein the step of directing at least one jet of atomized fluid comprises providing at least one electrogasdynamic water jet gun mounted on an enclosure which is electrically isolated from ground, so that charged water drops build up on the enclosure, repel other charged water drops, and drive them towards the electrically grounded hot material.

5. The method according to claim 2, wherein the hot material to be cooled is electrically conductive and is electrically grounded, and wherein the step of directing at least one jet of atomized fluid comprises providing at least one electrogasdynamic water jet gun mounted on an enclosure made of dielectric material, so that charged water drops build up on the enclosure, repel other charged water drops, and drive them towards the electrically grounded hot material.

6. The method according to claim 1, wherein the fluid reaching the hot material reaches substantial temperature equilibrium with the fluid vapor leaving the hot material surface, said temperature being substantially the boiling point of the fluid.

7. The method according to claim 1, further including the step of moving the hot material relative to the fluid jet, to help maintain the surface of the material at a uniform temperature.

8. The method according to claim 1, wherein the step of directing at least one jet of atomized fluid comprises directing at least one jet of liquid fluid drops and fluid vapor towards the surface of the hot material.

9. The method according to claim 1, wherein the step of directing at least one jet of atomized fluid comprises directing a plurality of jets of atomized fluid.

10. The method according to claim 9, wherein the hot material to be cooled has an irregular cross-section, and wherein the step of directing a plurality of jets of atomized fluid comprises directing jets each having a fluid flux approximately proportional to the material thickness where that fluid jet strikes the material, thereby achieving uniform cooling and minimizing distortion of the material.

11. The method according to caim 10, wherein the hot material to be cooled has an irregular cross-section of thicker and thinner cross-sections, wherein the step of directing a plurality of jets of atomized fluid comprises directing atomized fluid jets at the thicker cross-sections, and further including the step of directing a plurality of jets of gaseous medium at the thinner cross-sections.

12. The method according to claim 11, wherein the gaseous medium is air.

13. The method according to claim 9, wherein the hot material to be cooled comprises a flat plate, and wherein the step of directing a plurality of jets of atomized fluid comprises providing a plurality of jet guns arranged in a generally rectangular array.

14. The method according to claim 1, further including the step of directing a plurality of jets of gaseous medium towards the surface of the hot material, wherein the gaseous medium reaching the hot material reaches substantial temperature equilibrium with the fluid vapor leaving the hot material surface and the atomized fluid reaching the hot material, said temperature being close to the temperature of the fluid boiling point.

15. A method of cooling a hot material according to claim 1, said material having a generally tubular shape with walls formed during extrusion thereof by an extruder, comprising further spraying a jet of charged fluid drops into said tube from the extruder towards the open end of said tube, whereby fluid vapor generated by drops evaporating on the tube's inner wall leaves the tube at its open end.

16. The method according to claim 15, wherein the step of spraying comprises spraying a jet of fluid drops into said tube along the tube's central axis.

17. A method of cooling a hot material having a generally tubular shape with walls and a bottom, comprising spraying a jet of charged fluid drops into said tube towards the bottom surface with a speed, fluid drop size and flow rate so that some of the drops evaporate near the bottom surface where the jet strikes and the reminder of the drops are carried by the turbulent vapor caused by the jet along the inner walls toward the end of the tube, and so that some of the remainder drops evaporate along the inner walls before the vapor exits the tube end.

18. The method according to claim 17, wherein the hot material to be cooled is electrically conductive and electrically grounded, and wherein the step of spraying comprises spraying water droplets from an electrogasdynamic water spray gun, whereby the drops are electrostatically attracted to the inner walls and bottom to thereby increase the rate at which the hot material cools.

19. The method according to claim 18, wherein the step of spraying comprises spraying a jet of fluid drops into said tube along the tube's central axis.

20. An apparatus for cooling hot material with cooling fluid, comprising:

means for providing fluid;

means connected to said fluid providing means for producing at least one jet of atomizing fluid;

means for locating the hot material and the jet producing means to direct the jet towards the surface of the hot material; and said jet producing means having a jet speed $\mu_1$ greater than the speed of fluid vapor $C_v/4$ leaving the surface of the hot material and having a fluid mass flow rate per unit area $m_1/A$ from said jet to said material less than the rate at which vapor leaves the surface per unit area $\rho_v C_v/4$, where $\rho_v$ is the density of the vapor and $C_v$ is the mean thermal speed of the vapor molecules, to thereby prevent the formation of a fluid film on the material surface.

21. Apparatus according to claim 20, wherein the means for providing fluid comprises means for providing water, and wherein $\rho_v=5.98$ kg/m$^3$, $C_v=365$ m/s, and $m_1/A$ is less than $\rho_v C_v/4=2.18\times10^3$ kg/m$^2$-sec.

22. Apparatus according to claim 21, further including an electrically conductive and electrically grounded enclosure, wherein the means for producing at least one jet of atomized fluid comprises at least one electrogasdynamic water jet gun mounted on said enclosure, and wherein the hot material to be cooled is electrically conductive and is electrically grounded, so that charged water droplets are spayed by the jet gun into the enclosure.

23. Apparatus according to claim 20, wherein the fluid reaching the hot material reaches substantial temperature equilibrium with the fluid vapor leaving the hot material surface, said temperature being substantially at its boiling point.

24. Apparatus according to claim 20, further including means for moving the hot material relative to the produced jet, to help maintain the surface of the material at a uniform temperature.

25. Apparatus according to claim 20, wherein the means for producing at least one jet comprises at least one high speed fluid jet gun adapted to shoot liquid fluid drops and fluid vapor towards the surface of the hot material.

26. Apparatus according to claim 25, further including an enclosure electrically isolated from ground, wherein the jet gun is an electrogasdynamic water jet gun mounted on said enclosure, and wherein the hot material is electrically conductive and electrically grounded, so that charged water drops build up on the enclosure, repel other charged water drops, and drive them towards the electrically grounded hot material.

27. Apparatus according to claim 25, further including an enclosure made of dielectric material, wherein the jet gun is an electrogasdynamic water jet gun mounted on said enclosure, and wherein the hot material is electrically conductive and electrically grounded, so that charged water drops build up on the enclosure, repel other charged water drops, and drive them towards the electrically grounded hot material.

28. Apparatus according to claim 20, wherein the means for producing at least one jet comprises means for producing a plurality of jets of atomized fluid.

29. Apparatus according to claim 28, wherein the hot material to be cooled has an irregular cross-section, and wherein the means for producing a plurality of jets of atomized fluid comprises means for producing a plurality of jets each having a fluid flux approximately proportional to the material thickness where that fluid jet strikes the material, to thereby achieve uniform cooling and minimum distortion of the material.

30. Apparatus according to claim 28, wherein the hot material to be cooled has an irregular cross-section of the thicker and thinner cross-sections, and wherein the means for producing a plurality of jets of atomized fluid comprises means for producing a plurality of atomized fluid jets and directing said fluid jets at the thicker cross-sections, and further including means for producing a plurality of jets of gaseous medium and for directing said gas jets at the thinner cross-section.

31. Apparatus according to claim 28, wherein the hot material to be cooled comprises a flat plate, and wherein the means for producing a plurality of jets of atomized fluid comprises a plurality of jet guns arranged in a generally rectangular array.

32. Apparatus according to claim 20, further including means for producing a plurality of fluid jets in a gaseous medium towards the surface of the hot material, wherein the gaseous medium reaching the hot material reaches substantial temperature equilibrium with the fluid vapor leaving the hot material surface and the atomized fluid reaching the hot material, said temperature being close to the fluid boiling point temperature.

33. Apparatus according to claim 32, wherein the gaseous medium is air.

34. An apparatus for cooling a hot material having a generally tubular shape with walls and a bottom, comprising:

means for providing fluid;

means connected to said fluid providing means for producing at least one jet of charged fluid drops;

means for locating the hot tube and the jet producing means to direct the jet into said tube towards the bottom surface; and said jet producing means having a jet speed sufficient to penetrate fluid vapor leaving the surface of the hot material and having a fluid drop size and flow rate small enough to prevent formation of a liquid blanket on the material surface, so that some of the drops evaporate near the bottom surface where the jet strikes and the remainder of the drops are carried by the turbulent vapor caused by the jet along the inner walls toward the end of the tube, and so that some of the remainder drops evaporate along the inner walls before the vapor exits the tube end.

35. Apparatus according to claim 34, wherein the hot material to be cooled is electrically conductive, wherein said jet producing means comprises an electrogasdynamic water spray gun, and further including means for electrically grounding the hot material, whereby the drops are electrostatically attracted to the inner walls and bottom to thereby increase the rate at which the hot material cools.

36. Apparatus according to claim 34, wherein the jet producing means comprises means for spraying a jet of fluid drops into said tube along the tube's central axis.

37. An apparatus for cooling a hot material having a generally tubular shape with wall during extrusion thereof by an extruder, comprising:

means for providing fluid;

means connected to said fluid providing means for producing at least one jet of charged fluid drops;

means for locating the hot tube and the jet producing means to direct the jet into said tube from the extruder towards the open end of said tube; and said jet producing means having a jet speed sufficient to penetrate fluid vapor leaving the surface of the hot material and having a fluid drop size and flow rate small enough to prevent formation of a liquid blanket on the material surface, and so that fluid vapor generated by drops evaporating on the tube's inner wall leave the tube at its open end.

38. Apparatus according to claim 37, wherein the jet producing means comprises means for spraying a jet of fluid drops into said tube along the tube's central axis.

* * * * *